United States Patent [19]

Fasano

[11] Patent Number: 5,052,892

[45] Date of Patent: Oct. 1, 1991

[54] HIGH EFFICIENCY MIXER IMPELLER

[75] Inventor: Julian B. Fasano, Englewood, Ohio

[73] Assignee: Chemineer, Inc., Dayton, Ohio

[21] Appl. No.: 471,340

[22] Filed: Jan. 29, 1990

[51] Int. Cl.[5] ..... F04D 29/34; F04D 29/38

[52] U.S. Cl. ..... 416/204 R; 416/237; 416/DIG. 5

[58] Field of Search ..... 416/223 R, 231 A, 235, 416/237, 238, 242, 243, DIG. 2, DIG. 3, DIG. 5, 204 R; 366/343

[56] References Cited

U.S. PATENT DOCUMENTS

| | | | |
|---|---|---|---|
| 1,815,529 | 7/1931 | Shurtleff | 416/223 R |
| 1,838,453 | 12/1931 | Rosen | 416/237 |
| 1,980,614 | 11/1934 | Davy | 416/237 |
| 2,148,555 | 2/1939 | Hicks | 416/DIG. 3 |
| 2,288,917 | 7/1942 | Norris | 416/235 |
| 2,466,777 | 4/1949 | Morgan | 416/237 |
| 3,580,550 | 5/1971 | Hunnicutt | 416/237 |
| 3,887,169 | 6/1975 | Maynard | 416/237 |
| 4,054,272 | 10/1977 | Cooke | 366/343 |
| 4,147,437 | 4/1979 | Jonqueres | 366/343 |
| 4,468,130 | 8/1984 | Weetman | 366/330 |
| 4,519,715 | 5/1985 | Golobic | 366/343 |

FOREIGN PATENT DOCUMENTS

| | | | |
|---|---|---|---|
| 1600744 | 9/1970 | France | 416/243 |

OTHER PUBLICATIONS

Undated brochure Chemineer HE-3 High-Efficiency Impeller.

Two undated sheets of drawings entitled Chemineer--Kenics High Efficiency Impeller.

Undated glossy photograph of High Efficiency Impeller.

*Primary Examiner*—Edward K. Look

*Assistant Examiner*—James A. Larson

*Attorney, Agent, or Firm*—Biebel & French

[57] ABSTRACT

A high efficiency impeller has blades which are formed of plate material. Each blade has a first span-wise bend which extends generally parallel to the trailing edge and through about the center of the blade measured cord-wise and extending the length of the blade from the root end to the tip end. The first bend divides the blade into a back portion and a front portion. The front portion is further divided by a second bend line which extends from the intersection of the first bend line with the tip of the blade diagonally to the leading edge of the blade at a point about one-fifth to one-third the span-wise length outwardly from the blade root. The material of the blade is bent about each of the bend lines, in the same direction, to provide camber and concavity for the blade. The leading and trailing edges of the blade are chamfered.

9 Claims, 2 Drawing Sheets

HIGH EFFICIENCY MIXER IMPELLER

BACKGROUND OF THE INVENTION

This invention relates to a high efficiency impeller for mixing, blending and agitating liquids and suspensions of solids in liquids.

The measure of the efficiency of a mixing impeller is its ability to create more liquid motion for a given amount of energy expended. Chemical processes may be described by a defined level of mixing processing required. A high efficiency impeller is capable of providing the required process performance with less power, or in less time, or with an impeller of smaller size as compared to an impeller of less efficient design.

Usually bulk fluid velocity and a high level of conversion of the power into axial fluid flow are factors which indicate efficient impeller performance. An efficient impeller is usually one which has a high degree of axial flow (as compared to rotational and radial flow). This is flow which spreads less, and which permits the impeller to be placed a greater distance from the bottom of the mixing vessel.

A higher impeller efficiency has the secondary advantage of permitting a decrease in shaft length, thus reducing the cost of the shaft and inherent instability problems found with greater shaft lengths. Alternatively, a lighter weight impeller of the same or better efficiency permits the use of longer shaft lengths, since the critical speed limits the shaft length, and the critical speed for an impeller is inversely proportional to the square root of the impeller weight.

Also, the benefits of greater efficiency include the ability to use scaled down or smaller drive components, or permit an increase in processing rate with the same components.

An important consideration in the design of such an impeller is the amount of material in the hub and blades to carry the torque and thrust. Another consideration is the adaptability of the design to "scale" in size between small impellers of only a few inches in diameter to large units, which may measure 20 feet or more in diameter.

The amount of material, or at least, the ability to reduce critical materials, is important in the production of competitive impellers. In certain applications, it is necessary to form the impeller components of relatively high cost and/or critical materials, and in very large sizes, the material cost may become the most significant factor in the cost of the impeller.

As previously noted, the ability of the design to be scaled up (or down) while maintaining its performance is an important practical consideration. The ease of scaling is also a factor. Also important is the ability to make all the impeller components, especially blades, with the same bends, chamfers, and angles regardless of size. This consideration favors blades made of flat sections or at least sections which are free of critical radii which necessarily change with size.

A successful impeller design which meets many of the above parameters is known as the HE-3 of Chemineer, Inc., the assignee of this application. This impeller uses three equally-spaced blades formed of approximately rectangular flat plates, with a single camber-inducing bend extending span-wise from a point on the leading edge at about a 50% span station, to a point on the blade tip somewhat forward of the chord center. The blade portion forward of the bend is turned downwardly about the bend line through an angle of about 20°. The blade, at the root, is set on the support hub at a pitch angle of about 30°.

The HE-3 impeller meets may of the design criteria which are considered to be important to the commercial success of an agitating impeller, including the use of flat plate material formed or shaped with simple bends, to provide ease of scaling. It also exhibits desirably high axial flow characteristics. However, the blade design of the HE-3 impeller requires the use of relatively thick or heavy plate material, to provide sufficient beam strength at the root or hub end to support the bending and twisting loads on the blade. In the commercial embodiment, the hub, itself, at the blade attachment, is also reinforced by ribbing to augment the strength of the blade-conforming attachment boss.

There accordingly is a need for an agitation impeller which incorporates the design efficiencies of the HE-3 impeller, as outlined above, with less material weight and greater strength. Desirably, such an impeller should have performance characteristics which equal or exceed those of the HE-3.

SUMMARY OF THE INVENTION

This invention provides a high efficiency mixer or agitator impeller for use with mixing and agitating equipment. The preferred impeller embodiment has blades formed of plate material. The typical impeller of this invention is made with three generally radially extending and equally spaced blades, although as few as two and as many as four or more blades may be used in accordance with this invention.

While generally flat sections of plate material are employed in the design and manufacture of the blades, the blades nevertheless are formed with a radial concavity, defined as a downward cupping of the blade, when mounted on a vertical axis. This cupping is produced when the tangential section centers of the area created by the mean blade surface and the cord are connected. Such radial concavity or cupping serves to counteract the centrifugal force created on the liquid due to the fact that both the front and back surface velocity vectors tend to point inwardly toward the axis of rotation. However, the centrifugal force of the material or fluid being mixed tends to counteract this effect, thereby producing more nearly axial velocity vectors.

It has been found that a proper amount of such radial concavity assures that the discharge velocity profile from the impeller remains highly axial. Such a shape also avoids flow interferences and produces less turbulence and friction loss in the vicinity of the impeller.

These design objectives have been uniquely created in a propeller employing relatively flat sections of sheet material, beginning with a substantially rectangular blank which, before bending, has leading and trailing edges which are substantially parallel. In the finished blade, the cordwise length is substantially uniform throughout its span.

In the achievements of the above objectives, each blade is formed with first and second generally span-wise bend lines which divide the blade into three planar or flat sections joined along straight bend lines. However, the bend lines are not radial to the impeller shaft centerline. Each blade section is set from its connecting section at an angle along a common bend. Each bend angle is in the same direction, to provide camber.

A first bend line extends span-wise through the length of the blade from the root to the tip, and runs generally parallel to a leading or trailing edge, and generally midway of the chord, but preferably somewhat closer to the trailing edge that to the leading edge, and divides the blade into a front section and a rear section. The front blade section is further divided along a second bend line which extends in a straight line from the intersection of the first bend line, at the blade tip, diagonally through the front blade section. This second bend line intersects the blade leading edge at a span-wise station approximately one-fourth the length of the blade from the hub.

The total angle defined by the bend lines, providing the blade camber, is from about 20° to 30° at the tip, with the angle preferably being shared about equally between the two bend lines. The preferred range is for the angle at the first or principal bend line to be from about 10° to 25°, with the remainder, from about 5° to 15° at the second bend line, with the pitch angle (blade inclination) at the hub, measured in a straight line from the leading to trailing edge, between 25° and 30° to a circular plane normal to the axis of rotation of the hub. Both primary and secondary bends may vary in degree uniformly with radial location from the shaft centerline, but within the preferred ranges stated above.

In the preferred embodiment, both the leading and trailing edges are deeply chamfered, to improve flow therepast and reduce drag. Also, the blade is mounted on the hub with a small backward inclination (sweep) to assist in cleaning the leading edge, and with zero dihedral with respect to the hub. Chamfering is performed on the top surface of the leading edge and bottom surface at the trailing edge to improve the planform for the maximum attack angle.

The angular offset of the first and second blade sections along the first, generally radial, bend line provides a strong section modulus at the hub, and therefore permits a substantial reduction in the thickness of the plate material required to carry the same bending moments at the hub and along the blade length, or permits correspondingly greater blade loading. The beam section or shape also has a greater resistance to twisting, as compared to a simple rectangular section, and therefore better supports the blade in its design configuration throughout all anticipated blade loadings. The hub attachment bosses conform the blade shape and the hub, with increased strength, and potentially permits the elimination of the strengthening ribs, and a reduction in necessary weight.

Surprisingly, impellers using blades and hub as described, have been found to equal or surpass the already high efficiency of the successful HE-3 design. Decreased weight, and therefore decreased material and costs, are achieved without sacrificing efficiency. The thinner blade material better lends itself to forming at the bend lines, and the resulting sharper blade edges reduce drag, induced eddies, and turbulence. The lighter weight permits longer shaft extensions for the same shaft diameter, or the use of a smaller diameter for the same length.

It is therefore an object of the invention, as outlined above, to provide a mixer impeller with improved performance, lower weight, and lower cost.

Another object of the invention is the provision of an agitator in which the blades are formed of flat plate material, and the camber is formed by two bend lines thereby dividing the blades into three generally flat sections joined to each other along the bend lines forming a blade with a radial concavity.

A further object of the invention is the provision of a high efficiency agitator impeller in which three blades are formed from flat blanks, in which three flat section are joined along two straight bends lines, and in which a first bend line extends generally centrally of the blank radially from the root to the tip, and the second bend line extends diagonally from the intersection of the first bend line at the tip toward the hub, and intersection the leading edge about one-fourth the blade length from the hub.

Another object of the invention is the provision of an agitator impeller, as outlined above, having blades formed of plate material with a high section modulus at the root end to support the blade against bending a twisting moments.

A further object is the provision of an impeller, as outlined, which is high in efficiency, and which can be made in a wide range of sizes, while maintaining standardized values and manufacturing requirements.

BRIEF DESCRIPTION OF ACCOMPANY DRAWINGS

DESCRIPTION OF PREFERRED EMBODIMENT

Figure 1:
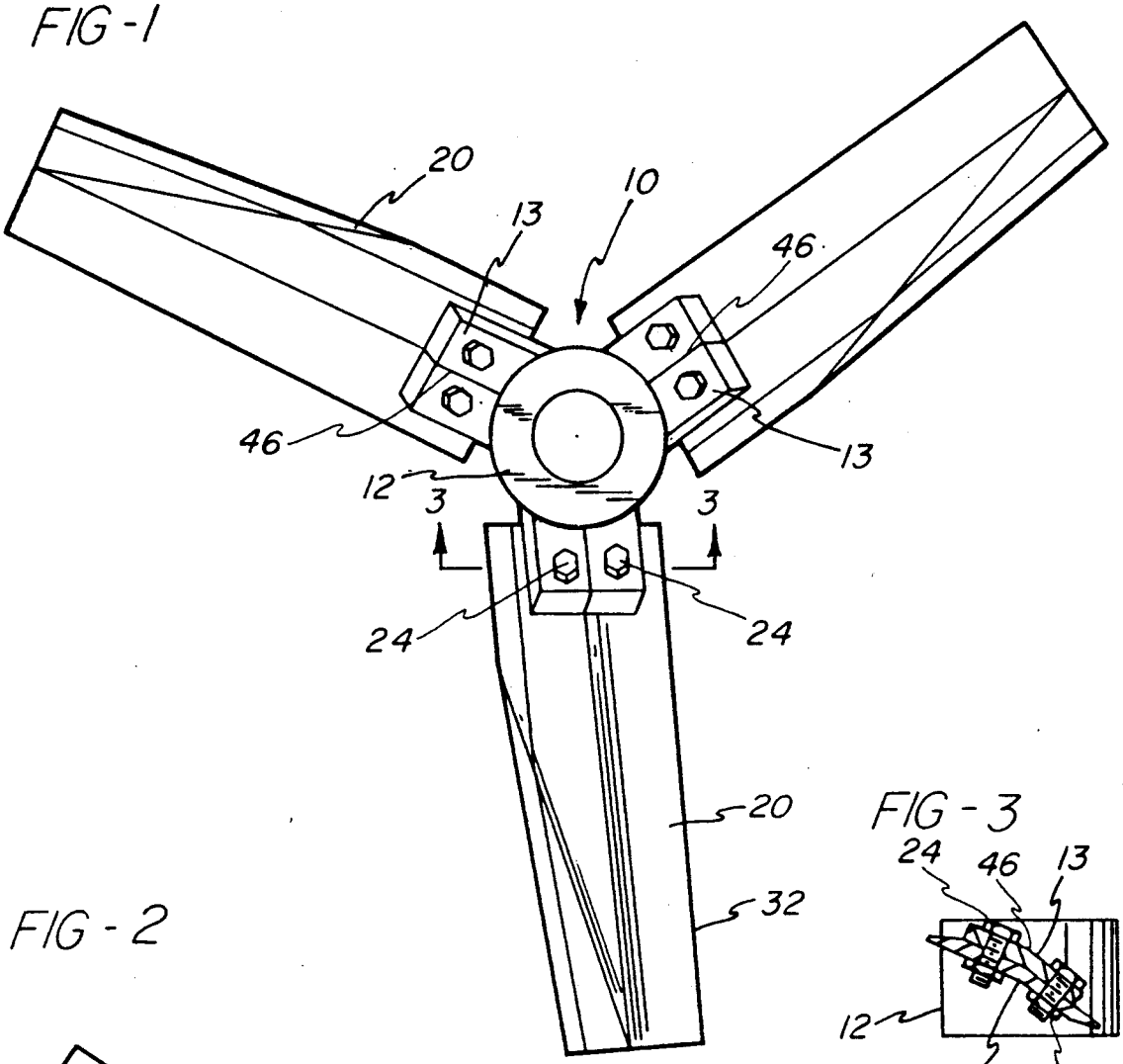
FIG. 1 is a top plan view of a three blade impeller according to this invention.
Figure 2:
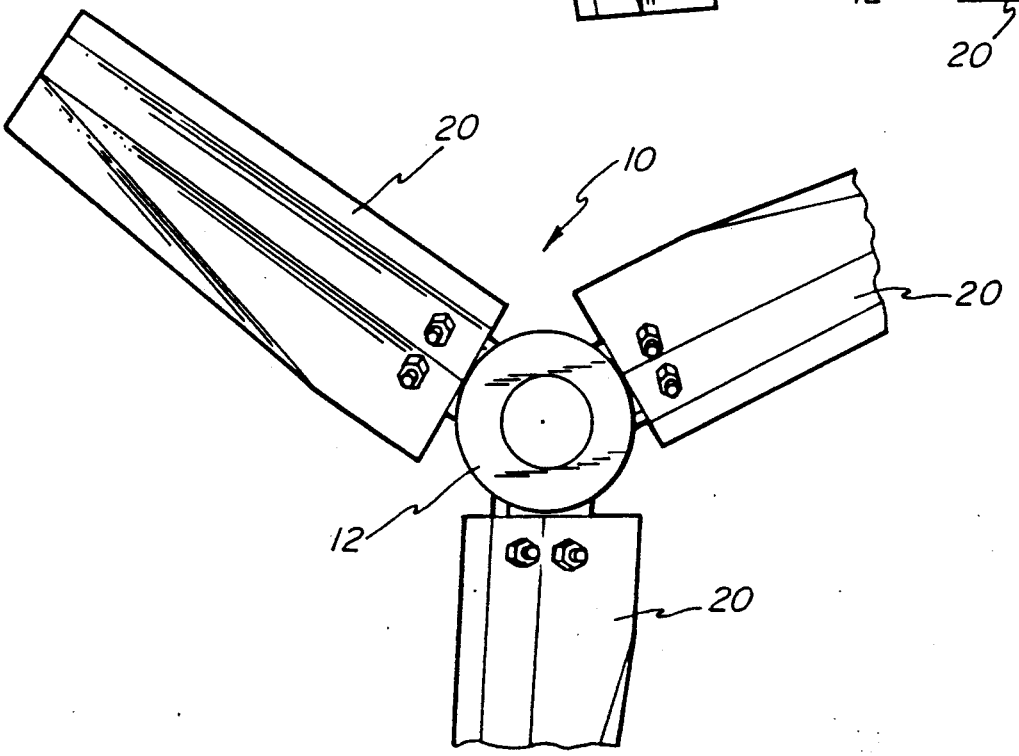
FIG. 2 is a bottom plan view thereof with the parts being partially broken away.

A three bladed impeller for mixing, conditioning, or agitating a liquid or a suspension within a vessel, is illustrated generally at 10 in FIGS. 1 and 2. The impeller of this invention includes a central hub 12 adapted to be mounted on a drive shaft, not shown. The hub 12 is provided with blade mounting bosses or flanges 13, as shown in FIG. 1. The flanges may be integrally formed or suitably welded or attached to the hub 12. The flanges 13 each support an impeller blade 20, and in the preferred embodiment, the impeller 10 has three blades 20 positioned in equally spaced 120° relation with respect to the axis of the hub 12.

Figure 4:
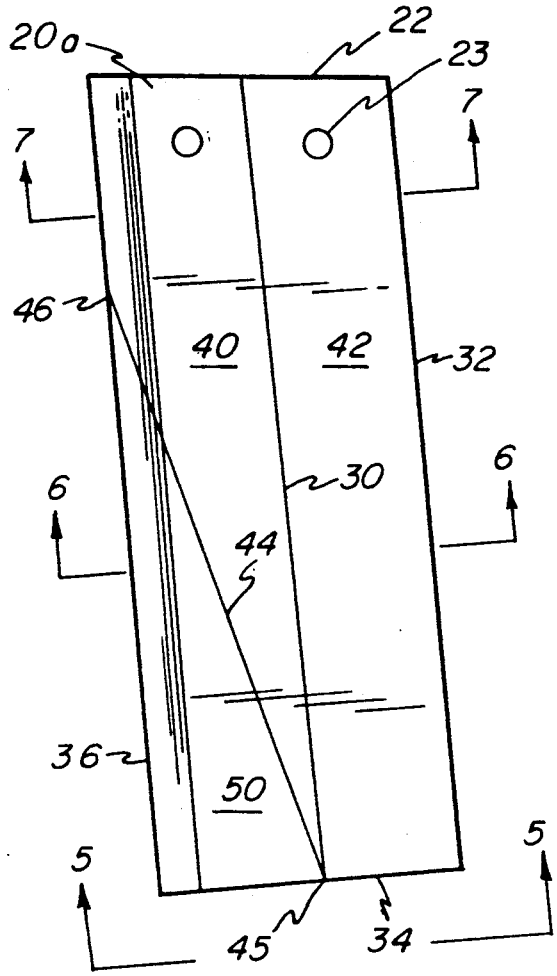
FIG. 4 is a plan view of one of the blade blanks showing the bend lines.

Each blade 20 is formed from an identical blank **20*a* of flat metal as shown in plan view in FIG. 4**. The blades are formed from blanks of plate material and are substantially rectangular in shape.

The root 22 of the blade 20 is provided with suitable means for attachment to one of the hub flanges, such as the bolt-receiving openings 23 of the blank **20*a* as shown in FIG. 4. The blades are attached to the hub flanges 13 by pairs of fasteners 24 which extend though the flanges and the bolt-receiving openings 23. The plate material of the blanks has a substantially uniform thickness throughout its length. In fabricating the blade 20, the blade 20*a* is formed with a first span-wise bend or bend line 30 which is positioned approximately parallel to the blade trailing edge 32. The bend 30 extends in a straight line from the root 22 to the blade tip 34, and intersects the tip somewhat rearwardly of the center of the blade as measured along the blank between the leading edge 36 and the trailing edge 32. The bend line 30 divides the blade 20 into a flat front blade portion 40 and an angularly offset flat back blade portion 42. The angles formed at the bend line 30** defines a first camber angle $\alpha$ for the blade.

The flat blade portion 40 is divided by a second bend or bend line 44. The bend line 44 extends in a straight line from the point 45 of intersection of the bend 30 with the tip 34, diagonally of the blade to the leading edge 36. The bend 44 intersects the blade leading edge at a position 46 which is spaced radially outwardly from the root 22, approximately one-third to one-fifth the effective span of the blade 20.

The bend line 44 forms a third flat blade section 50, which is formed at a second camber angle $\beta$ to the section 40 to which it is attached. The sections 40 and 42 form an angle at the bend line which is additive to the angle $\beta$ formed between the section 40 and the section 50 at the bend line 44, to define the total blade camber. The total bend angle measured at the tip is in the range of about 20° to 30°, and is shared approximately equally at bend lines 30 and 44 by the angles $\alpha$ and $\beta$.

The preferred range for the bend angle $\alpha$ between the sections 40 and 42, is about 10° to 25° with a variable angle of 25° to 12½ being typical and preferred. The remainder of the total bend, that is from about 5° to 15°, is formed at the bend line 44 between the blade sections 40 and 50, with the preferred angle $\beta$ being about 12½. The blade mounting flange 13 as shown in FIG. 3, is formed with an angle corresponding to the angle of the blade sections 40 and 42 about the bend line 30, at the root end 22 so that the flange conforms to the surface of the blade.

As previously noted, the bend angle $\alpha$ formed about the line 30, dividing the blade sections 40 and 42, need not be of a constant value but may be variable. Thus, the angle defined about the line 30 may be greater at the root 22 than at the blade tip 34, and the angle may be tapered uniformly from root to tip. The spanwise bend at the root can vary between 10° to 25° and taper to about 10° to 15° at the tip. For example, the angle defined by the blade sections 40 and 42, at the root, may be in the order of 25°, and taper to a smaller angle in the order of 12½° at the tip. This has the effect of providing a higher section modulus at the root to resist bending loads on the blade.

Figure 3:
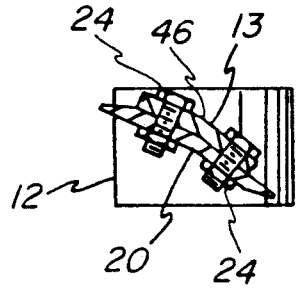
FIG. 3 is a section through one of the blades and the hub flange looking generally along the line 3—3 of FIG. 1.

As shown in FIGS. 1 and 3, each of the hub flanges 13 is formed with a generally radial bend 46 and conforms to the shape of the upper surface the blade sections 40,42 at the blade root 22. When the blades are mounted to the hub 12, as shown in FIG. 1, the bend lines 30 intersect the respective hub flanges 13 between the fasteners 24 and at the flange bends 46.

The angular offset of the first and second blade sections about the generally radially bend line 30 provides a very strong section modulus for the blade at the root 22 and at the blade hub 12. This accordingly permits a substantial reduction in the thickness of the plate material forming the blank 20*a* which would otherwise be necessary to carry the bending moments and loads from the blades to the hub. The beam also has high strength and resistance to twisting, as compared to a simple flat rectangular section, and provides excellent support for the blades.

Figure 7:
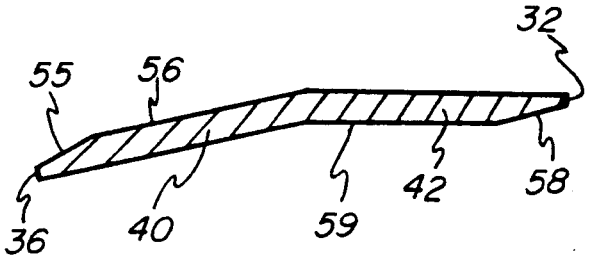
FIG. 7 is a further sectional view through the blade looking generally along the line 7—7 of FIG. 4.
Figure 5:
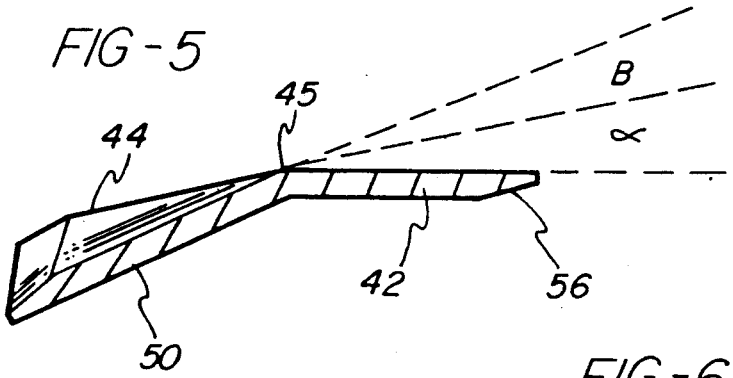
FIG. 5 is an end view of the blade blank after bending and forming, looking along the line 5—5 of FIG. 4.
Figure 6:
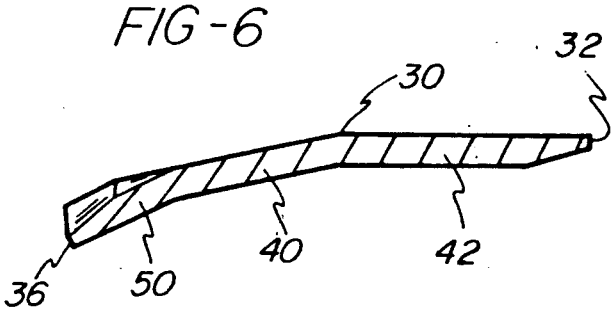
FIG. 6 is a transverse sectional view of a blade after bending and forming, looking generally along the 6—6 of FIG. 4.

Preferably, both the top surface of leading edge 36 and bottom surface of the trailing edge 32 are chamfered with a relatively shallow angle of less than 45° with the plane of the respective section. As perhaps best shown in FIG. 7, the top leading edge chamfer 55 forms an angle of approximately 15° with the top surface 56 of the blade, while a bottom trailing edge chamfer 58 forms a similar angle of about 15° to the bottom surface 59 of the blade. The chamfering improves the blade planform for maximum angle of attack. The deeply chamfered leading and trailing edges also assist in improving efficiency of the blade operating in a liquid medium, and reduce drag which would otherwise be formed by induced eddy currents and resulting turbulence.

The top chamfer 55 does not intersect the leading edge at the bottom surface of the blade, but rather intercepts the leading edge slightly above the bottom surface to form a slightly blunt or flat leading edge 36, primarily to prevent inadvertent injury to personnel handling the blade. Similarly, the trailing edge chamfer 58 does not intercept the upper surface directly at the trailing edge 32, but rather is slightly spaced from the bottom so as to leave a slightly blunt trailing edge.

The blade, as defined by the position of the bend line 30, does not extend truly radially from the hub 12, but rather is swept rearwardly through an angle of about 5° to a radial. This negative sweep assists in keeping the blade edge clean and is found to provide a gain in performance.

The angle of pitch of the blade, as measured at the root along a straight cord line extending from the leading edge to the trailing edge, in relation to the plane of rotation, may be varied as required to suit the particular conditions, but typically may be about 15° to 30°.

A particular advantage of the impeller of this invention is that the design is free of critical curvatures, the radius of which would change in scaling the blade from one size to another. Since the blade is made up primarily of flat sections, joined along straight bend lines, scaling is substantially simplified as compared to blade designs which are curved, and the relationship between the blade sections and the blade angles themselves may be maintained substantially uniform from size to size. As previously mentioned, the bends 30 and 44 separating respectively the blade sections 40 and 42 and the leading blade section 50 from the section 40, combine to provide an effective downward cupping, also known as radial concavity, with respect to the hub. This occurs even though the true dihedral as viewed along the bend line 30 may be neutral or zero, to contribute to a lower cost of manufacture. This radial concavity, as previously mentioned, contributes to the efficiency of the blade by counteracting the centrifugal force which tends to disrupt the axial velocity vectors from the blade, and therefore, the discharge profile from the impeller of this invention remains highly axial. The degree of axial flow is often viewed as a good measure of the efficiency of the impeller.

As previously noted, the blade and impeller design of this application provides rather substantial and unexpected improvements over current high efficiency designs, such as the previously identified HE-3 impeller. Typically, a three-bladed impeller according to the present application will provide the same pumping efficiency at about 89% of the torque required for a corresponding HE-3 design. Further, such an impeller has been found to be approximately 20% lighter in weight, thereby permitting either longer shaft extensions for the same shaft diameter or smaller diameter shafts for the same extension length. The weight savings on the impeller have permitted maximum shaft extensions which are approximately 8% longer than those currently in use with the HE-3 impeller.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A high efficiency multiple bladed mixer impeller in which blades of plate material extend generally radially from a central hub, the improvement comprising:

each blade having a root joined to the hub, and a remote tip, and having a cord-wise length uniform throughout the spanwise length of said blade, each said blade having first a span-wise camber bend extending in a line from said root end to said tip dividing the blade into a front portion defining a blade leading edge and a back portion, said front portion being further divided by a second camber bend, said second bend extending in a line from the intersection of said first bend with the blade tip diagonally to a point on said leading edge spaced radially outwardly from said root and extending along a major span-wise extent of the blade and forming a camber angle with the remainder of said front portion.

2. The impeller of claim 1 in which said first and second bends combine to define a radial cavity in the form of a downward cupping in relation to a vertical axis of rotation to counteract the tendency for centrifugal flow from said impeller blades.

3. A high efficiency bladed mixer impeller in which blades of plate material extend generally radially from a central hub, the improvement comprising:

each blade having a root end joined to the hub and a remote tip, and having a cord-wise length substantially uniform throughout its spanwise length, and having a leading edge and a trailing edge, said blade having first span-wise bend extending generally parallel to the trailing edge forming a camber angle of about 25° to 12½° and extending the length of the blade from said root end to said tip dividing the blade into a front portion and a back portion, said front portion being further defined by a second bend, said second bend extending in a straight line from the intersection of said first bend with the blade tip diagonally to a point on said leading edge spaced about one-fifth to one-third the span-wise length outwardly from said root and forming a camber angle with the reminder of said first portion of about 12°.

4. the impeller of claim 3 in which said camber angle of said first spanwise bend is greater at the blade root than at the blade tip.

5. In a high efficiency mixer impeller with a hub and having generally radially extending plate-type blades in which the blades are formed from flat blanks which have cord-wise widths which are substantially uniform along the lengths of said blade from the roots to the tips, the improvement comprising:

three essentially flat blade sections joined along bend lines forming blade camber angles including a span-wise bend line extending generally radially from said hub at said blade root approximately along the cordwise center of said blank and intersecting said blade tip dividing said blade into a front blade section and a rear blade section, and a second bend line extending in a straight line from the intersection of said span-wise bend line with said tip diagonally through said front blade section and intercepting the leading edge of the blade at approximately one-fifth to one-third the span-wise length thereof from said root, said span-wise bend line each of said bend lines forming a blade camber angle of at least about 10° and not more than about 25° said second bend line forming a blade camber angle of at least about 5° and not more than about 15°, and the total of said angles being not less than about 20° and not more than about 30°.

6. The improvement of claim 5 in which the leading edge of each said blade is chamfered at an angle to said leading edge rearwardly to the blade top at an angle of less than 45° to the blade bottom at said front section, and the trailing edge of each said blade is chamfered at an angle extending from the blade bottom and sloping upwardly to the trailing edge at an angle of less than 45° to the plane of blade top at said rear section.

7. A high efficiency multiple bladed mixer impeller, comprising:

a central blade support hub adapted to be mounted on a drive shaft, a plurality of generally radially-extending blade mounting flanges on said hub, a corresponding plurality of blades each formed of a generally rectangular blank of plate material each having a root, a tip remote from said root, a leading edge and a trailing edge, each said blade having a first bend extending spanwise along a line from said root to said tip dividing said blade into a front portion including said leading edge and a back portion including said trailing edge, said bend being defined by a camber angle $\alpha$, each said blade front portion being formed with a second bend extending along a line from the intersection of said first bend with said tip diagonally to a point on said leading edge spaced radially outwardly of said blade root, said second bend extending along a substantial spanwise extent of said blade, and being defined by an angle $\beta$ when viewed from said tip, said angle $\beta$ being in the same direction as said angle $\alpha$, the total of said angles $\alpha$ and $\beta$ taken at said blade tip being between about 20° to 30° and shared about equally between said bend lines, said blade mounting flanges being formed with a generally radial bend so that the flanges conform to the shape of the associated said blade at said root end, and means connecting each said blade to an associated said blade flange with said spanwise bend intersecting said mounting flange.

8. The impeller of claim 7 in which said mounting flanges support said blades at a pitch angle measured in a straight line from said blade leading edge to said trailing edge to a circular plane normal to the axis of rotation of said hub between 25° and 30°.

9. The impeller of claim 7 in which said intersection points on said leading edges are each at a position on the associated said blade about one-fourth the spanwise length of said blade.

* * * * *